US005668092A

United States Patent [19]

Denton

[11] Patent Number: 5,668,092

[45] Date of Patent: Sep. 16, 1997

[54] ROCK BIT GREASE COMPOSITION

[75] Inventor: Robert M. Denton, Friendswood, Tex.

[73] Assignee: Smith International, Inc., Houston, Tex.

[21] Appl. No.: 629,764

[22] Filed: Apr. 8, 1996

Related U.S. Application Data

[63] Continuation-in-part of Ser. No. 293,496, Aug. 19, 1994, abandoned, which is a continuation-in-part of Ser. No. 44,579, Apr. 7, 1993, abandoned.

[51] Int. Cl.[6] ..... C10M 107/02; C10M 107/08; C10M 141/00; E21B 10/16

[52] U.S. Cl. ..... 508/146; 508/591; 175/224; 175/228; 175/371

[58] Field of Search ..... 508/146, 273, 508/175, 177, 591; 175/227, 228, 371

[56] References Cited

U.S. PATENT DOCUMENTS

| | | | |
|---|---|---|---|
| 2,990,025 | 6/1961 | Talbout et al. | 175/375 |
| 3,727,705 | 4/1973 | Newman | 175/374 |
| 4,298,481 | 11/1981 | Clarke | 508/273 |
| 4,320,017 | 3/1982 | Spence | 252/43 |
| 4,358,384 | 11/1982 | Newcomb | 252/19 |
| 4,409,112 | 10/1983 | Urmy, Jr. | 252/52 R |
| 4,481,122 | 11/1984 | Root et al. | 508/273 |
| 4,634,545 | 1/1987 | Zaleski et al. | 252/29 |
| 4,840,740 | 6/1989 | Sato et al. | 252/51.5 A |
| 4,842,752 | 6/1989 | Hardy et al. | 252/17 |
| 4,877,557 | 10/1989 | Kaneshige et al. | 252/56 |
| 4,912,272 | 3/1990 | Wu | 585/10 |
| 4,956,122 | 9/1990 | Watts et al. | 252/565 |
| 4,986,923 | 1/1991 | Waynick | 252/25 |
| 5,015,401 | 5/1991 | Landry et al. | 252/18 |

(List continued on next page.)

FOREIGN PATENT DOCUMENTS

| | | |
|---|---|---|
| 191608 | 8/1985 | European Pat. Off. . |
| 492458 | 7/1992 | European Pat. Off. . |
| 511547 | 11/1992 | European Pat. Off. . |

OTHER PUBLICATIONS

Brochure: "Amoco Polybutene" (Amoco Chem. Co., 1990); month unknown pp. 1–3, 14–19, 23–35

Product Desc.: Vistanex LM (Exxon Chem. n.d. 1 pg.); date unknown.

Anglamol 6063A (Lubrizol Corp., Nov. 1990, 8 pg.); Lubrizol 6662 (Lubrizol Corp. Nov. 1990, 5 pg.); Parapol (Exxon Chem., Sep. 1992, 2 pg.).

Emery 3004 PAO 4 cST (Henkel Corp. Sep. 190, 2 pg.); Vanlube 829 (R.T. Vanderbilt Co., n.d. Doc. No. VL–829–1, 1pg.).

Parapol 2500 (Exxon Chem. n.d. Doc. No. 03–813720/9111, 2 pg.).

Lucant (Mitsui Petrochem. Jun. 1986, 12 pg.) Texacar, Jun. 1989, 1pg.; Molyvan L (R.T. Vanderbilt Co., n.d. Doc. No. MVL–1. (no date).

C.V. Smalhear & R. Karidy Smith, *Lubricant Additives* 1967 month unknown.

*Primary Examiner*—Margaret Medley

*Attorney, Agent, or Firm*—Christie, Parker & Hale, LLP

[57] ABSTRACT

A rock bit for drilling subterranean formations is lubricated with a grease composition made from a high-viscosity synthetic lubricant basestock and a combination of lubricant additives. The grease composition preferably has in the range of from 1 to 20 percent by weight polyisobutylene, in the range of from 50 to 90 percent by weight ethylene-alphaolefin, up to approximately 40 percent by weight polyalphaolefin, and in the range of from 4 to 45 percent by weight lubricant additives. The rock bit grease composition has a viscosity index in the range of from about 250 to 325, and has an absolute viscosity of greater than about 100,000 centipoise at a temperature of approximately 70° F. and at a shear rate of less than about 40 seconds$^{-1}$, without the use of solid metal-containing extreme pressure agents or thickening agents. The grease composition forms a lubricant film having enhanced thicknesses, when compared to conventional mineral oil-based greases, to provide excellent rock bit bearing lubrication.

12 Claims, 1 Drawing Sheet

U.S. PATENT DOCUMENTS 5,037,567 8/1991 Farng et al. ..... 252/32.7 E
5,089,156 2/1992 Chrisope et al. ..... 252/49.9
5,102,565 4/1992 Waynick ..... 508/177
5,104,579 4/1992 Benjamin et al. ..... 252/46.6
5,105,038 4/1992 Chen et al. ..... 585/10
5,186,747 2/1993 Mattingly ..... 106/468
5,194,621 3/1993 Karol et al. ..... 252/47.5

ROCK BIT GREASE COMPOSITION

REFERENCE TO PATENT APPLICATION

This application is a continuation-in-part of patent application Ser. No. 08/293,496 filed on Aug. 19, 1994 and abandoned on May 6, 1996, which was a continuation-in-part of parent patent application Ser. No. 08/044,579 filed on Apr. 7, 1993 and abandoned on Oct. 19, 1994.

FIELD OF THE INVENTION

This invention relates to a grease composition comprising synthetic lubricant basestocks and various lubricant additives for lubricating journal bearings in a rock bit for drilling oil wells or the like.

BACKGROUND

Heavy-duty rock bits are employed for drilling wells in subterranean formations for oil, gas, geothermal steam, and the like. Such bits have a body connected to a drill string and a plurality, typically three, of hollow cutter cones mounted on the body for drilling rock formations. The cutter cones are mounted on steel journals or pins integral with the bit body at its lower end. In use, the drill string and bit body are rotated in the bore hole, and each cone is caused to rotate on its respective journal as the cone contacts the bottom of the bore hole being drilled.

While such a rock bit is used in hard, tough formations, high pressures and temperatures are encountered. The total useful life of a rock bit in such severe environments is in the order of 20 to 200 hours for bits in sizes of about 6 to 28 inch diameter at depths of about 5000 to 20,000 feet. Useful lifetimes of about 65 to 150 hours are typical.

When a rock bit wears out or fails as a bore hole is being drilled, it is necessary to withdraw the drill string for replacing the bit. Prolonging the time of drilling minimizes the lost time in "round tripping" the drill string for replacing bits.

Replacement of a drill bit can be required for a number of reasons, including wearing out or breakage of the structure contacting the rock formation. One reason for replacing the rock bits includes failure or severe wear of the journal bearings on which the cutter cones are mounted. The journal bearings are lubricated with grease adapted to severe conditions. Lubrication failure can sometimes be attributed to misfit of bearings or seal failure, as well as problems with a grease.

The journal bearings are subjected to very high pressure drilling loads, high hydrostatic pressures in the hole being drilled, and high temperatures due to drilling, as well as elevated temperatures in the formation being drilled. Considerable development work has been conducted over the years to produce bearing structures and employ materials that minimize wear and failure of such bearings.

A variety of grease compositions have been employed in the past. Such grease compositions comprise a generally low viscosity, refined petroleum or hydrocarbon oil basestock which provides the basic lubricity of the composition and may constitute about ¾ of the total grease composition. Such basestock oil is thickened with a conventional metal soap or metal complex soap wherein the metal is aluminum, barium, calcium, lithium, sodium, or strontium U.S. Pat. No. 4,358,384 discloses such a grease composition comprising a petroleum derived mineral oil lubricant basestock and a metal soap petroleum derived mineral oil lubricant basestock and a metal soap or metal complex soap including aluminum, barium, calcium, lithium, sodium or strontium metals.

In order to enhance the film lubricating capacity of such petroleum basestock greases, solid additives such as molybdenum disulfide, copper, lead or graphite must be added. Synthetic polymer extreme pressure agents (EPA) are also used. Such additives serve to enhance the ability of the lubricant basestock to form a film between the moving metal surfaces under conditions of extreme pressure. U.S. Pat. Nos. 4,358,384, 3,062,741, 3,107,878, 3,281,355, and 3,384,582 disclose the use of molybdenum disulfide, and other solid additives such as copper, lead and graphite which have been employed to attempt to enhance the lubrication properties of oils and greases.

It is also known to include metallic oxides like zinc oxide in lubrication oils. U.S. Pat. No. 2,736,700 describes the use of molybdenum disulfide and a metallic oxide such as fumed lead oxide and zinc oxide in a ratio of two parts molybdenum disulfide to one part metallic oxide, in a paint-on composition, or bonded lubricant containing a lacquer drying agent. Such bonded lubricants are inadequate and could not be used in the heavily loaded applications for which this invention is intended.

However, the use of solid extreme pressure agents have been shown to contribute to rock bit seal failure. For example, rock bit lubricant compounds comprising a copper extreme pressure agent have displayed seal failures due to copper deposits and loading near the seal area. The copper accumulates near the seal area until the seal is abraded by the constant and progressive erosive contact with the copper deposit. The abraded seal eventually loses its capacity to retain the grease composition in the journal area, permitting metal to metal contact between the cone and journal, causing rock bit failure.

Also, in today's society of heightened environmental awareness the use of solid extreme pressure agents comprising heavy metal complexes are not desirable due to their toxicity and environmental impact. For example, popular solid extreme pressure agents comprising lead must be treated as a toxic material during manufacturing and use of the rock bit. The use of such toxic materials during both the manufacturing and use of the rock bit presents a potential environmental hazard with respect to the manufacture, storage, use and final disposal of the rock bit.

It is therefore desirable to provide a grease composition for lubricating rock bits that protects the journal bearing surfaces from premature wear or failure during service at the high temperatures, bearing pressures and rotational speeds often found in modern rock bits. It is also desirable that the grease composition complement the sealing arrangement and promote optimum sealing. It is further desirable that the grease composition be substantially free of metal lubricant additives that can be both toxic to humans and hazardous to the environment.

BRIEF SUMMARY OF THE INVENTION

There is, therefore, provided in practice of this invention according to a presently preferred embodiment, a grease composition for lubricating rock bits used for drilling subterranean formations. The grease composition comprises high viscosity synthetic lubricant basestocks and lubricant additives and does not include any metal-based thickeners or thickening agents. The synthetic lubricant basestocks comprise polyisobutylene having a Flory molecular weight in the range of from 42,000 to 46,000 and having a Brookfield viscosity at 350° F. in the range of from 26,000 to 35,000 centipoise, and at least one other synthetic lubricant selected from the group consisting of ethylene-alphaolefin having a Flory molecular weight in the range of from 32,000 to 38,000 and having a Brookfield viscosity at 350° F. in the range of from 80 to 200 centipoise, and polyalphaolefin having a Flory molecular weight in the range of from 800 to 2,000 and having a Brookfield viscosity at 350° F. of less than about two centipoise, and mixture therof. The lubricant additives may comprise extreme pressure agents, anti-wear agents, heat stabilizers, antioxidants, pour point depressants, thickening agents and the like to achieve the desired physical properties of the grease composition.

A preferred grease composition, prepared according to principles of this invention, has an absolute viscosity greater than about 100,000 centipoise at a temperature of approximately 70° F., and at a shear rate less than about 40 seconds$^{-1}$, and more preferably has an absolute viscosity of approximately 135,000 centipoise at the same temperature and at a shear rate of approximately 22 seconds$^{-1}$.

A preferred embodiment of the grease composition comprises in the range of from 1 to 20 percent by weight polyisobutylene, in the range of from 50 to 90 percent by weight ethylene-alphaolefin, up to approximately 40 percent by weight polyalphaolefin and in the range of from 4 to 45 percent by weight lubricant additives.

BRIEF DESCRIPTION OF THE DRAWINGS

A rock bit lubricated with such a grease composition is illustrated in semi-schematic perspective in FIG. 1 and in a partial cross-section in FIG. 2.

DETAILED DESCRIPTION

A rock bit employing a grease composition comprising synthetic high-viscosity lubricant basestocks and lubricant additives comprises a body 10 having three cutter cones 11 mounted on its lower end. A threaded pin 12 is at the upper end of the body for assembly of the rock bit onto a drill string for drilling oil wells or the like. A plurality of tungsten carbide inserts 13 are pressed into holes in the surfaces of the cutter cones for bearing on the rock formation being drilled. Nozzles 15 in the bit body introduce drilling mud into the space around the cutter cones for cooling and carrying away formation chips drilled by the bit.

Figure 1:
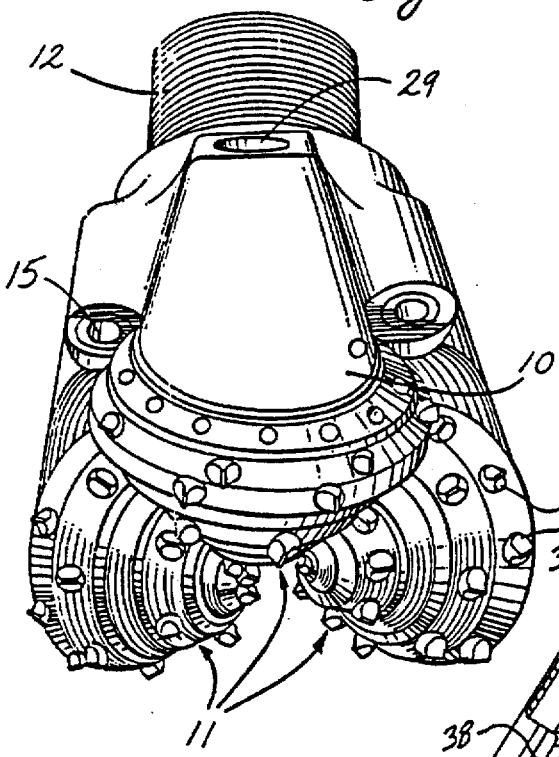
Figure 2:
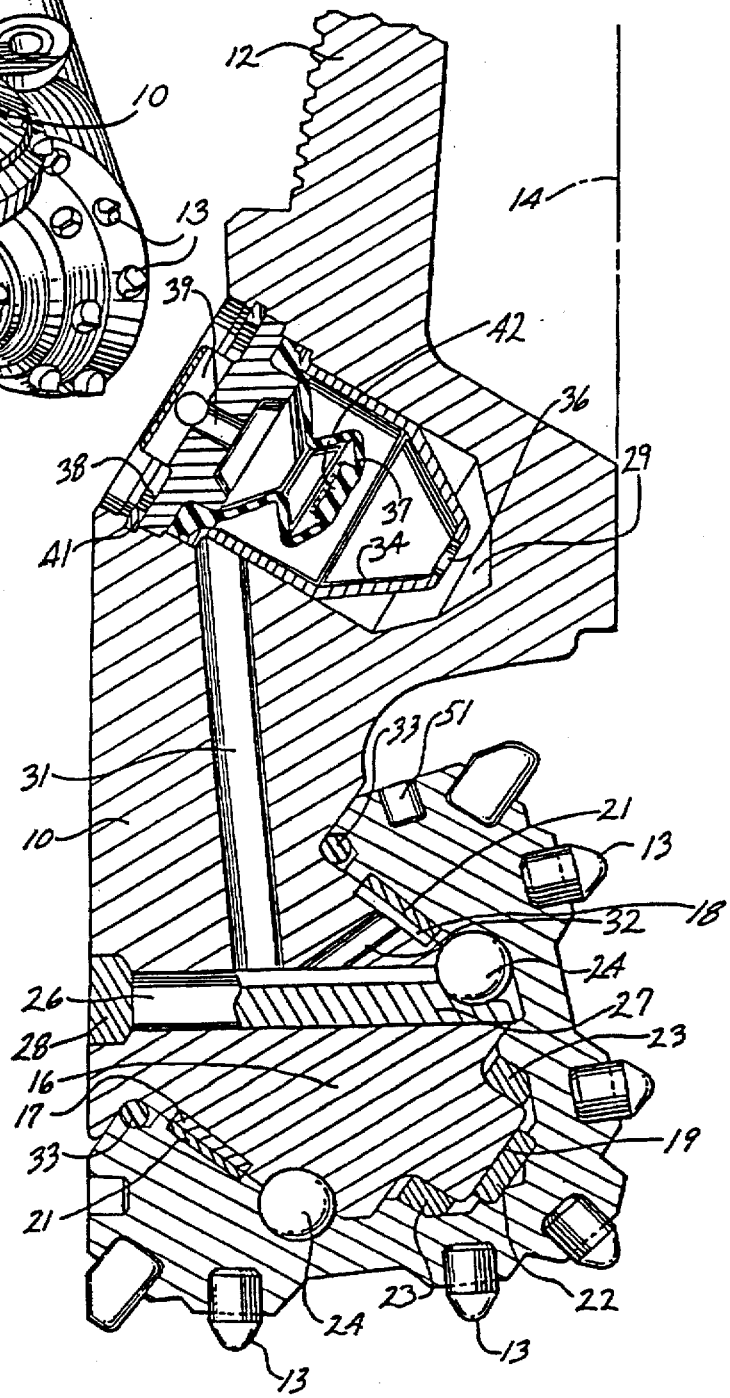

FIG. 2 is a fragmentary, longitudinal cross section of the rock bit, extending radially from the rotational axis 14 of the rock bit through one of the three legs on which the cutter cones 11 are mounted. Each leg includes a journal pin 16 extending downwardly and radially inwardly on the rock bit body. The journal pin includes a cylindrical bearing surface having a hard metal insert 17 on a lower portion of the journal pin. An open groove 18 is provided on the upper portion of the journal pin. Such a groove may, for example, extend around 60% or so of the circumference of the journal pin, and the hard metal 17 can extend around the remaining 40% or so. The journal pin also has a cylindrical nose 19 at its lower end.

Each cutter cone 11 is in the form of a hollow, generally-conical steel body having tungsten carbide inserts 13 pressed into holes on the external surface. For long life, the inserts may be tipped with a polycrystalline diamond layer. Such tungsten carbide inserts provide the drilling action by engaging a subterranean rock formation as the rock bit is rotated. Some types of bits have hard-faced steel teeth milled on the outside of the cone instead of carbide inserts.

The cavity in the cone contains a cylindrical bearing surface including an aluminum bronze insert 21 deposited in a groove in the steel of the cone or as a floating insert in a groove in the cone. The aluminum bronze insert 21 in the cone engages the hard metal insert 17 on the leg and provides the main bearing surface for the cone on the bit body. A nose button 22 is between the end of the cavity in the cone and the nose 19 and carries the principal thrust loads of the cone on the journal pin. A bushing 23 surrounds the nose and provides additional bearing surface between the cone and journal pin.

Other types of bits, particularly for higher rotational speed applications, have roller bearings instead of the exemplary journal bearings illustrated herein.

A plurality of bearing balls 24 are fitted into complementary ball races in the cone and on the journal pin. These balls are inserted through a ball passage 26, which extends through the journal pin between the bearing races and the exterior of the rock bit. A cone is first fitted on the journal pin, and then the bearing balls 24 are inserted through the ball passage. The balls carry any thrust loads tending to remove the cone from the journal pin and thereby retain the cone on the journal pin. The balls are retained in the races by a ball retainer 27 inserted through the ball passage 26 after the balls are in place. A plug 28 is then welded into the end of the ball passage to keep the ball retainer in place.

The bearing surfaces between the journal pin and cone are lubricated by a grease composition. Preferably, the interior of the rock bit is evacuated, and grease is introduced through a fill passage (not shown). The grease thus fills the regions adjacent the bearing surfaces plus various passages and a grease reservoir. The grease reservoir comprises a cavity 29 in the rock bit body, which is connected to the ball passage 26 by a lubricant passage 31. Grease also fills the portion of the ball passage adjacent the ball retainer, the open groove 18 on the upper side of the journal pin, and a diagonally extending passage 32 therebetween. Grease is retained in the bearing structure by a resilient seal 33 between the cone and journal pin.

A pressure compensation subassembly is included in the grease reservoir 29. This subassembly comprises a metal cup 34 with an opening 36 at its inner end. A flexible rubber bellows 37 extends into the cup from its outer end. The bellows is held in place by a cap 38 with a vent passage 39. The pressure compensation subassembly is held in the grease reservoir by a snap ring 41.

When the rock bit is filled with grease, the bearings, the groove 18 on the journal pin, passages in the journal pin, the lubrication passage 31, and the grease reservoir on the outside of the bellows 37 are filled with grease. If the volume of grease expands due to heating, for example, the bellows 37 is compressed to provide additional volume in the sealed grease system, thereby preventing accumulation of excessive pressures. High pressure in the grease system can damage the seal 33 and permit abrasive drilling mud or the like to enter the bearings. Conversely, if the grease volume should contract, the bellows can expand to prevent low pressures in the sealed grease systems, which could cause flow of abrasive and/or corrosive substances past the seal.

A grease composition provided in the practice of this invention for lubricating rock bits comprises high viscosity synthetic lubricant basestocks and lubricant additives for enhancing film strength and load-carrying capacity, thermal stability, oxidation resistance, corrosion resistance and thickening. An exemplary grease composition is prepared by combining:

(a) a polyisobutylene or isobutylene copolymer; with
(b) ethylene-alphaolefin; and/or
(c) polyalphaolefin; with (d) lubricant additives for enhancing the film strength and load-carrying capacity, thermal stability, oxidation resistance and corrosion resistance, and for thickening the synthetic lubricant basestocks.

An important physical property of a lubricant is its viscosity, or its resistance to flow. The viscosity of a lubrication composition determines that composition's ability to flow and form a lubricating film between opposing metal surfaces. A lubrication composition having a high viscosity generally has low flow characteristics but is a good film former once in place. A lubrication composition having a low viscosity generally has high flow characteristics but is a poor film former, especially under conditions where the opposing metal surfaces interact under conditions of extreme pressures.

The viscosity of a lubricating composition is also influenced by temperature. Generally speaking, as the temperature of lubricating composition increases, its viscosity decreases. Therefore, the composition's ability to form a lubricating film also decreases as the temperature increases. The ability of a lubricating composition to resist viscosity change under temperature is referred to as the viscosity index (VI). A lubrication composition having a VI of 100 would exhibit relatively small changes in viscosity with temperature. A lubrication composition having a VI of 0 would exhibit a relatively large change in viscosity with temperature. Many lubricants have a low VI and are unsuitable for the extreme conditions encountered in a rock bit.

In selecting a lubricant basestock for the rock bit grease composition of the present invention it is desired that the basestock have a high viscosity and a high viscosity index in order to ensure good film formation between the journal bearings throughout the temperature range of the drilling operation. For this reason, synthetic lubricant basestocks are preferred over petroleum derived basestocks.

With respect to the isobutylene copolymer, it is preferred that the grease composition comprise polyisobutylene. Polyisobutylene is a highly paraffinic rubber-like hydrocarbon polymer composed of a straight chain molecule having a Flory molecular weight in the range of from 42,000 to 46,000 and an extremely high viscosity in the range of from 26,000 to 35,000 centipoise at a temperature of 350° F. (177° C). Polyisobutylene is commercially available, for example, from the Exxon Chemical Company Polymers Group of Houston, Tex. under the product name Vistanex LM. The polyisobutylene copolymer has a density of approximately 914 kilograms/cubic meter at 23° C. and is used to provide adhesiveness to the grease composition, enhancing its ability to cling or stick to surfaces that it comes into contact with. The polyisobutylene also provides high-temperature stability and improves the viscosity index of the grease composition.

The grease composition comprises at least one other synthetic lubricant basestock selected from the group consisting of ethylene-alphaolefins, polyalphaolefins, and mixtures thereof. A preferred ethylene-alphaolefin is a hydrocarbon-based synthetic oil of ethylene and alphaolefin having a Flory molecular weight in the range of from 32,000 to 38,000, a Brookfield viscosity at 350° F. in the range of from 80 to 200 centipoise. A preferred ethylene-alphaolefin has a viscosity index of approximately 300. Ethylene-alphaolefin is commercially available, for example, from Mitsui Petrochemical Industries, Ltd of Japan under the product name Lucant 2000. Ethylene-alphaolefin is a desirable synthetic lubricant basestock because of its combined high viscosity and excellent viscosity index, therefore, permitting its use under varying temperature conditions with more consistent changes in film forming and lubricating ability.

The other preferred synthetic lubricant basestock is polyalphaolefin. Polyalphaolefin is a linear alphaolefin that has undergone polymerization and hydrogenation. The polyalphaolefin is commercially available, for example, from the Henkel Corporation of Cincinnati, Ohio under the product name Emery 3004. The polyalphaolefin has a Flory molecular weight in the range of from 800 to 2000 and has a Brookfield viscosity at 350° F. (177° C.) of less than about 2 centipoise and is used primarily as a solvent for polyisobutylene to facilitate its dissolution during the preparation of the grease composition. The polyalphaolefin has a viscosity index in the range of from 130 to 175.

With respect to the lubricant additives, the grease composition may comprise various types of additives depending on the particular physical properties desired for the rock bit grease composition.

The grease composition may comprise extreme pressure agents (EPA) for enhancing its film strength and load-carrying capacity. Preferred EPAs are non-metallic sulfur containing compounds such as substituted 1,3,4-thiadiazole that is commercially available, for example, from R. T. Vanderbilt Company, Inc. of Norwalk, Conn. under the product name Vanlube 829, and a non-metallic chloride-sulfur-phosphorus compound commercially available, for example, from the Lubrizol Corporation of Wickliffe, Ohio under the product name Anglamol 6063A.

The substituted 1,2,4-thiadiazole is a non-metallic powder that possesses excellent extreme pressure properties when dispersed in the synthetic lubricant basestock and also functions as an anti-wear agent and an antioxidant. The chloride-sulfur-phosphorus compound is a non-metallic liquid that possesses excellent extreme pressure properties when added to the synthetic lubricant basestock and also provides corrosion resistance to the grease composition.

The rock bit grease composition may comprise lubricant additives for enhancing thermal stability and oxidation resistance. A preferred lubricant additive is an organic liquid molybdenum-sulfur-phosphorus compound commercially available from the R. T. Vanderbilt Company, Inc. of Norwalk, Conn. under the product name Molyvan L. The molybdenum-sulfur-phosphorus compound serves to enhance the oxidation and friction resistance of the grease composition. The liquid molybdenum-sulfur-phosphorus compound also possesses anti-wear and extreme pressure properties. The use of such a liquid molybdenum compound eliminates problems associated with the use of solid molybdenum additives.

The rock bit grease composition may comprise lubricant additives for enhancing corrosion resistance and lowering the pour point of the grease composition. A preferred lubricant additive is an alkyl ester copolymer compound that is commercially available, for example, from the Lubrizol Corporation of Wickliffe, Ohio under the product name Lubrizol 6662. The alkyl ester copolymer serves to depress the pour point of the grease composition, ensuring that the composition remains in liquid form and flows under operating conditions of low temperature. The alkyl ester copolymer depresses the pour point of the grease composition without affecting any other characteristics such as the viscosity or the viscosity index (VI) of the composition. The alkyl ester copolymer also serves to enhance the corrosion resistance of the grease composition.

The rock bit grease composition may comprise a thickening agent to transform the viscous liquid synthetic basestocks and lubricant additives to a semi-solid form. The thickening agent may be selected from the group consisting of fine silica, fine clay and silica gel. A key feature of this grease composition is that it does not require the use of solid metal thickeners or thickening agents to provide a desired film thickness, a desired viscosity index, and a desired high viscosity. The grease composition is completely free of solid metals. The ability to form a grease composition having such film thickness, viscosity index and viscosity characteristics is rather attributed to the use of wholly synthetic lubricant basestocks, thereby eliminating the need to depend on toxic solid metals. A preferred thickening agent is silica gel and is commercially available, for example, from Cabot Corporation of Cambridge, Mass. under the product name Cab-O-Sil M5. The silica gel serves to transform the liquid synthetic basestocks and lubricant additives to a semi-solid form.

The rock bit grease composition may also comprise propylene carbonate. The propylene carbonate is a surfactant that facilitates the wetting of the silica gel thickening agent, thus allowing the silica gel to more readily disperse in the lubricant. A suitable propylene carbonate composition is commercially available from Texaco Chemical Company of Houston, Tex. under the product name Texacar Propylene Carbonate.

The principal portion of the grease composition comprises synthetic lubricant basestocks that provide the basic lubricity. Thus, about ¾ by weight of the grease composition is such synthetic lubricant basestock. Synthetic lubricant basestocks are preferred over petroleum derived basestocks because of their increased viscosity and high viscosity index (VI). However, high viscosity petroleum derived basestocks may also be used in the practice of this invention. Selecting synthetic lubricant basestocks having such viscosity characteristics permits the formulation of a rock bit grease composition without the need for using solid extreme pressure agents such as lead, copper or molybdenum sulfide or metal soaps to ensure the desired degree of lubricant film strength and load-carrying capacity.

The grease composition comprises synthetic lubricant basestocks in the range of from 55 to 95 percent by weight of the total grease composition. A grease composition comprising less than 55 percent by weight synthetic lubricant basestocks may not possess the basic lubricity required for rock bit lubrication. A grease composition comprising greater than 95 percent by weight synthetic lubricant basestocks will not contain the quantity of lubricant additives such as EPAs needed to produce a grease composition having the desired degree of lubrication film strength and load-carrying capacity for operation at the high temperatures and pressures encountered in rock bit bearings.

It is preferred that the grease composition comprise in the range of from 1 to 20 percent by weight polyisobutylene. A grease composition comprising less than 1 percent by weight polyisobutylene may not possess the degree of adhesiveness desired to make the grease composition adhere to metal surfaces. A grease composition comprising greater than 20 percent by weight polyisobutylene will be too viscous to serve as a rock bit lubricant in low temperature applications. Other lower molecular weight polyisobutylenes may be used to prepare the grease composition of the present invention. However, the proportion of lower molecular weight polyisobutylene used to prepare the grease composition of the present invention would need to be increased.

In addition to the polyisobutylene, the grease composition comprises at least one other synthetic lubricant basestock selected from the group consisting of ethylene-alphaolefin and polyalphaolefin.

A grease composition comprising ethylene-alphaolefin and polyisobutylene as synthetic lubricant basestocks preferably comprises in the range of from 50 to 90 percent by weight ethylene-alphaolefin and in the range of from 1 to 20 percent by weight polyisobutylene.

A grease composition comprising polyalphaolefin and polyisobutylene preferably comprises approximately 40 percent by weight polyalphaolefin and in the range of from 1 to 20 percent by weight polyisobutylene.

A grease composition comprising ethylene-alphaolefin, polyalphaolefin and polyisobutylene as synthetic lubricant basestocks comprises in the range of from 50 to 90 percent by weight ethylene-alphaolefin, up to about 40 percent by weight polyalphaolefin, and in the range of from 1 to 20 percent by weight polyisobutylene. The preferred grease composition comprises approximately 76 percent by weight ethylene-alphaolefin, 6 percent by weight polyalphaolefin and 2 percent by weight polyisobutylene.

A grease composition comprising less than 50 percent by weight ethylene-alphaolefin may not possess the basic lubricity required for a rock bit lubricant. A grease composition comprising greater than 90 percent by weight ethylene-alphaolefin does not contain an adequate amount of lubricant additives needed to provide the desired degree of film strength for load-carrying ability.

A grease composition comprising greater than 40 percent by weight polyalphaolefin excessively diminishes the viscosity of the lubricant and does not have the fluid film forming capability needed for a rock bit lubricant.

The grease composition is prepared by combining the synthetic lubricant basestocks in the preferred proportions with various lubricant additives. The grease composition preferably comprises in the range of from 5 to 45 percent by weight various lubricant additives.

The grease composition may comprise extreme pressure agents such as substituted 1,2,4-thiadiazole and a chloride-sulfur-phosphorus compound. The grease composition preferably comprises in the range of from 0.1 to 25 percent by weight substituted 1,2,4-thiadiazole and in the range of from 1 to 10 percent by weight the chloride-sulfur-phosphorus compound. A grease composition comprising less than 0.1 percent by weight of the substituted 1,2,4-thiadiazole and less than 1 percent by weight of the chloride-sulfur-phosphorus compound produces a grease composition having lubrication film strength and load-carrying capacity too low to serve as a rock bit lubricant in high temperature, high load, low speed applications. A grease composition comprising greater than 25 percent by weight substituted 1,2,4-thiadiazole and greater than 10 percent by weight of the chloride-sulfur-phosphorus compound produces a grease composition having chemical reactivity which may cause excessive wear of rock bit bearings. A particularly preferred grease composition comprises approximately 3 percent by weight substituted 1,2,4-thiadiazole and approximately 5 percent by weight the chloride-sulfur-phosphorus compound.

The grease composition may also comprise a lubricant additive for enhancing the thermal stability and oxidation resistance of the synthetic lubricant basestock. The grease composition preferably comprises a molybdenum-sulfur-phosphorus compound in the range of from 1 to 10 percent by weight of the total grease composition. A grease composition comprising less than 1 percent by weight of the molybdenum-sulfur-phosphorus compound produces a grease compound having a low degree of oxidation resistance. A grease composition comprising greater than 10 percent by weight of the molybdenum-sulfur-phosphorus compound produces a grease composition with chemical reactivity that may cause excessive wear of rock bit bearings. A particularly preferred grease composition comprises approximately 3 percent by weight the molybdenum-sulfur-phosphorus compound.

The grease composition may comprise a lubricant additive for enhancing corrosion resistance and lowering the pour point of the grease composition. The grease composition preferably comprises an alkyl ester copolymer in the range of from 0.1 to 5 percent by weight of the total grease composition. A grease composition comprising less than 0.1 percent by weight alkyl ester copolymer produces a grease composition having a high pour point that may not be desired when operating under low temperature drilling conditions. A grease composition comprising greater than 5 percent by weight alkyl ester copolymer is economically impractical because the grease composition contains more of the additive than needed to depress the pour point to a desired level. A particularly preferred grease composition comprises approximately 0.3 percent by weight alkyl ester copolymer.

The grease composition preferably comprises a thickening agent such as silica gel in the range of from 2 to 8 percent by weight of the total grease composition. A grease composition comprising less than 2 percent by weight silica gel produces a liquid grease composition and not a semi-solid grease composition. A grease composition comprising greater than 8 percent by weight silica gel produces a grease composition that is too hard for lubricating rock bits. A particularly preferred grease composition comprises approximately 5 percent by weight silica gel.

The grease composition preferably comprises propylene carbonate in the range of from 0.1 to 3 percent by weight of the total grease composition. A grease composition comprising less than 0.1 percent by weight propylene carbonate contains an inadequate quantity to ensure wetting and suspension of the silica gel thickening agent. A grease composition comprising greater than 3 percent by weight propylene carbonate contains more propylene carbonate than is needed for silica gel wetting, and thus is economically impractical. A particularly preferred grease composition comprises approximately 0.3 percent by weight propylene carbonate.

The rock bit grease composition is prepared by combining together, in the proper proportions, the high-viscosity synthetic lubricant basestocks and the desired lubricant additives. The lubricant basestocks and additives are then mixed together by conventional mixing means to produce a homogeneous rock bit grease composition. The rock bit grease composition is characterized as having a high viscosity that is less dependent on temperature (high viscosity index) and has a Flory molecular weight in the range of from 23,000 to 33,000. The rock bit grease composition, prepared according to principles of this invention, has a viscosity index in the range of from about 250 to 325 and, more preferably, has a viscosity index of approximately 275. The grease composition has an absolute viscosity greater than about 100,000 centipoise at a temperature of approximately 70° F., and at a shear rate less than about 40 seconds$^{-1}$ and, more preferably, has an absolute viscosity of approximately 135,000 centipoise at the same temperature and at a shear rate of approximately 22 seconds$^{-1}$.

The grease composition displays these viscosity characteristics without the need for using solid lubricant additives that may damage and ultimately cause the failure of the rock bit seals. Further, the grease composition is solid metal free and, thus provides such desired viscosity characteristics without the need for using metal particles or any type of solid metal thickening agents or extreme pressure agents that otherwise pose a toxic waste hazard with respect to the environment and that are known to be harmful to rock bit seals.

EXAMPLE

A preferred grease composition was prepared by combining Emery 3004 (polyalphaolefin) and Vistanex LM (polyisobutylene) synthetic lubricant basestocks in the ratio of 65:35 to make a first master as shown in Table 1. A second master was prepared by combining Emery 3004 (polyalphaolefin) and Vanlube 829 (substituted 1,3,4-thiadiazole extreme pressure agent) in the ratio of 50:50 as shown in Table 1.

TABLE 1

| MATERIAL | SPECIFIC GRAVITY | POUNDS/ GALLON | WEIGHT PERCENT | VOLUME (GALLONS) |
|---|---|---|---|---|
| First Master | | | | |
| Emery 3004 (polyalphaolefin) | 0.82 | 6.82 | 65.00 | 9.531 |
| Vistanex LM (polyisobutylene) | 0.895 | 7.446 | 35.00 | 4.701 |
| Second Master | | | | |
| Emery 3004 (polyalphaolefin) | 0.82 | 6.82 | 50.00 | 7.331 |
| Vanlube 829 (Substituted 1,3,4-Thiadiazole) | 2.09 | 17.389 | 50.00 | 2.875 |

After preparing the first and second master, a preferred grease composition was prepared by combining the first and second master with Lucant 2000 (ethylene-alphaolefin synthetic lubricant basestock), Anglamol 6063A (chloride-sulfur-phosphorus extreme pressure agent), Lubrizol 6662 (alkyl ester copolymer corrosion inhibitor), Holyvan L (molybdenum-sulfur-phosphorus thermal and oxidation stabilizer), Cab-O-Sil M5 (silica gel thickening agent) and propylene carbonate in the proportions shown in Table 2.

TABLE 2

| MATERIAL | SPECIFIC GRAVITY | POUNDS/ GALLON | WEIGHT PERCENT | VOLUME (GALLONS) |
|---|---|---|---|---|
| First Master | 0.844 | 7.026 | 4.93 | .702 |
| Second Master | 1.178 | 9.798 | 5.91 | .063 |
| Lucant 2000 (ethylene-alphaolefin) | .850 | 7.072 | 76.29 | 10.788 |
| Anglamol 6063A (chloride-sulfur-phosphorus compound) | 1.015 | 8.445 | 4.93 | .584 |
| Lubrizol 6662 (alkyl ester copolymer) | .905 | 7.53 | 0.25 | .033 |
| Molyvan L (molybdenum-sulfur-phosphorus compound) | 1.08 | 8.986 | 2.46 | .274 |
| Cab-O-Sil M5 (Silica gel) | 2.10 | 17.472 | 4.93 | .282 |
| Propylene Carbonate | 1.2057 | 10.03 | 0.30 | 0.03 |

The grease composition prepared in this manner had a viscosity index of approximately 300, and had an absolute viscosity of approximately 135,000 centipoise at a temperature of approximately 70° F., and at a shear rate of approximately 22 seconds$^{-1}$. Table 2a sets forth the absolute viscosity characteristics of the grease composition at 70°, 125°, 200° and 25° F., and at a constant shear rate of approximately 22 seconds$^{-1}$. Table 2a also sets forth, for comparison purposes, absolute viscosity characteristics for a conventional petroleum derived mineral oil based grease composition that is disclosed in Example 1 of U.S. Pat. No. 4,358,384, which is herein incorporated by reference. The viscosity characteristics for the mineral oil based grease composition was taken at the same temperatures and under the same shear stress conditions.

TABLE 2a

| Temperature | Synthetic based grease composition | Mineral oil based grease composition |
|---|---|---|
| 70° F. | 135,000 cP | 40,000 cP |
| 125° F. | 30,000 cP | 12,000 cP |
| 200° F. | 18,000 cP | 10,000 cP |
| 250° F. | 14,000 cP | 3,500 cP |

The viscosity date presented in Table 2a illustrates the superior viscosity of the rock bit grease composition, prepared according to principles of this invention, comprising entirely synthetic lubricant basestock oils when compared to a conventional mineral oil based grease composition across a wide temperature range. At 70° F., the grease composition of this invention has a viscosity that is greater than three times that of the mineral oil based grease composition, and at 250° F. the grease composition has a viscosity that is approximately four times greater than the mineral oil based composition.

The high viscosity characteristics of the grease composition of this invention, when compared to the mineral oil based composition, demonstrates that the grease composition is better adapted to form a thick lubricating film to lubricate the rock bit bearing surfaces and, thus is more effective at lubricating the rock bit.

Table 3 sets forth elastohydrodynamic (EHD) film thickness data that was taken for both the grease composition of this invention, and for the mineral oil based grease composition described above, at a rolling velocity of approximately 50 in./sec.

TABLE 3

| Temperature | Synthetic based grease composition | Mineral oil based grease composition |
|---|---|---|
| 250° F. | $37 \times 10^{-6}$ in. | $16 \times 10^{-5}$ in. |
| 300° F. | $29 \times 10^{-6}$ in. | $12.5 \times 10^{-6}$ in. |

The EHD film thickness data clearly illustrates the superior film thickness forming capability of the grease composition of this invention when compared to that of the mineral oil based composition. The grease composition of this invention generates a film thickness that is approximately 200 percent greater than that of the mineral oil based grease composition, thereby providing significantly improved rock bit lubrication.

Table 4 sets forth further film thickness data, measuring the rolling velocity that is needed for each grease composition to form a given film thickness at a fixed temperature of approximately 250° F.

TABLE 4

| Film thickness | Synthetic based grease composition | Mineral oil based grease composition |
|---|---|---|
| $5.7 \times 10^{-6}$ | 1.0 in./sec | 6.5 in./sec |
| $13 \times 10^{-6}$ | 4.8 in./sec | 36.7 in./sec |
| $17.6 \times 10^{-6}$ | 8.3 in./sec | 50.1 in./sec |

The rolling velocity data in Table 4 illustrates that it takes a much higher rolling velocity for the mineral oil based grease composition to reach the same film thickness as the grease composition of this invention, supporting the fact that the grease composition of this invention is a more effective film former and, thus provides significantly improved rock bit lubrication.

TESTS AND TEST RESULTS

Examples of the grease compound prepared in this manner were subjected to testing under conditions designed to resemble down hole conditions encountered during the actual use of a rock bit. The grease composition was subjected to three different types of radial bearing tests (RBT) which measured the difference in torque and temperature of a bushing and complementary shaft that was run against each other in the presence of the grease compound for a period of twenty hours. Each test was carried out by placing a circular bearing material resembling the type of material used in rock bits into an arbor capable of both retaining and rotating the bearing. A cylindrical shaft of sufficient diameter made from a stellite alloy steel was inserted inside the circular bearing. The grease composition was injected into a grease reservoir located within the arbor body from a cavity within the shaft in such a manner that the grease composition was interposed between the bearing and shaft surface. The grease compound was retained within the reservoir by means of a O-ring seal located between the bearing and the cylindrical shaft.

The first type of RBT performed was a standard RBT which was conducted under conditions approximating average down hole rock bit conditions. The bearing used in this test was made from a bronze material. The second type of RBT was a boundary RBT which was conducted under conditions approximating extreme down hole rock bit conditions. Like in the first test, a bronze bearing material was chosen. The third type of RBT performed was an A-21 test run under average down hole rock bit conditions using an aluminum bronze bearing material.

The standard RBT was conducted by rotating the bearing about the cylindrical shaft at approximately 240 rpm for a period of twenty hours under a load of approximately 2,500 pounds. The bronze bearing area subjected to contact with the shaft in the test was approximately 0.35 square inches. Data relating to the torque required to spin the bearing and the temperature at the shaft surface near the bearing interface were collected, averaged and compared with other lubricant compounds. Under these conditions the grease composition prepared according to the present invention exhibited a significant reduction in average torque when compared to petroleum based lubricants not comprising the additives of the present invention as shown in Table 5. The grease composition of the present invention did not exhibit a reduction in temperature.

TABLE 5

| Standard RBT | | |
|---|---|---|
| Test Parameters | Petroleum Based Grease Composition | Present Invention |
| Ave Torque (in. lbs) | 7 | 3 |
| Ave Temp (°F.) | 120 | 126 |

The decrease in average torque and temperature indicates the superior lubricating qualities of the grease composition of the present invention. The test data supports the superior film forming capacity of the grease composition which serves to maintain a lubrication boundary between the bearing and shaft surfaces, reducing friction between the members, which results in a reduction of torque required to spin the bearing and a reduction of temperature between the two members.

The boundary RBT was conducted by rotating the bearing about the cylindrical shaft at approximately 200 RPM for a period of twenty hours under a load of approximately 2,500 pounds. The bronze bearing area subjected to contact with the shaft in this test was approximately 0.12 square inches. Data relating to the torque required to spin the bearing and the temperature at the shaft surface near the bearing interface were collected, averaged and compared with other lubricant compounds. Under these conditions the grease composition of the present invention exhibited a significant reduction in torque and temperature when compared with that of a petroleum based lubricant not comprising the additives of the present invention as shown in Table 6.

TABLE 6

| Boundary RBT | | |
|---|---|---|
| Test Parameters | Petroleum Based Grease Composition | Present Invention |
| Ave Torque (in. lbs) | 28.5 | 12.6 |
| Ave Temp (°F.) | 163 | 136 |

The test data supports the superior film forming capacity of the grease composition which serves to maintain a lubrication boundary between the bearing and shaft surfaces, reducing friction between the members as measured by a reduction in the amount of torque required to spin the bearing.

The A-21 RBT was conducted by rotating the bearing about the cylindrical shaft at approximately 200 RPM for a period of twenty hours under a load of approximately 2,500 pounds. The aluminum bronze bearing area subjected to contact with the shaft in this test was approximately 0.12 square inches. Data relating to the torque required to spin the bearing and the temperature at the shaft surface near the bearing interface were collected, averaged and compared with other lubricant compounds. When compared to petroleum based lubricants not comprising the additives of the present invention, the grease composition prepared according to the present invention exhibited a significant reduction in average torque and average temperature as shown in Table 7.

TABLE 7

| A-21 RBT | | |
|---|---|---|
| Test Parameters | Petroleum Based Grease Composition | Present Invention |
| Ave Torque (in. lbs) | 28 | 11 |
| Ave Temp (°F.) | 163 | 133 |

The test data supports the superior film forming capacity of the grease composition which serves to maintain a lubrication boundary between the bearing and shaft surfaces, reducing friction between the members, which results in a reduction of torque required to spin the bearing and a reduction of temperature between the two members.

Although limited embodiments of rock bit have been described herein, many modifications and variations will be apparent to those skilled in the art. The exemplary bit described and illustrated is no more than that; there are a variety of bit configurations known in which the grease composition may be used. Accordingly, it is to be understood that the rock bit grease composition of the present invention may be used with rock bits other than that specifically described herein.

It is also to be understood within the scope of the present invention that the grease composition may comprise a variety of other lubricant additives than specifically described. For example, the grease composition may comprise other types of extreme pressure agents, corrosion inhibitors, oxidation inhibitors, anti-wear inhibitors or thickening agents. The grease composition may include additional lubricant additives such as graphite to enhance the lubrication characteristics of the present invention. Additionally, the grease composition may comprise lubricant additives not specifically described such as water repellents, anti-foam agents, color stabilizers, odor-control agents and the like.

It is also to be understood within the scope of this invention that the rock bit grease composition may comprise lubricant basestocks other than that specifically described in the preferred embodiment. For example, lubricant basestocks use in the present invention may include synthetic polymers such as low molecular weight polyisobutylene or polybutene. Additionally, the lubricant basestocks may include flourosilicone compounds or high-viscosity paraffinic non-napthenic petroleum polymers. These alternative lubricant basestocks may be combined with either the lubricant additives specifically defined in the preferred embodiment or with alternative lubricant additives to achieve the desired lubrication characteristics for use is a rock bit.

It is therefore to be understood that, within the scope of the appended claims, this invention may be practiced otherwise than as specifically described.

What is claimed is:

1. A rock bit for drilling subterranean formations comprising:

a bit body including a plurality of journal pins, each having a bearing surface;

a cutter cone mounted on each journal pin and including a bearing surface;

a grease reservoir in communication with such bearing surfaces;

a solid metal free grease composition in the grease reservoir and adjacent the bearing surfaces, the grease composition having a viscosity index in the range of from 250 to 325 and comprising:

in the range of from about 55 to 95 percent by weight synthetic lubricant basestocks comprising:

in the range of from about 1 to 20 percent by weight polyisobutylene having a Flory molecular weight in the range of from 42,000 to 46,000;

in the range of from about 50 to 90 percent by weight ethylene-alphaolefin having a Flory molecular weight in the range of from 32,000 to 38,000; and up to about 40 percent by weight polyalphaolefin having a molecular weight in the range of from 800 to 2,000; and lubricant additives comprising:

a 1,3,4-thiadiazole compound;

a sulfur-chloride-phosphorus compound;

an alkyl ester copolymer;

a silica gel compound: and a propylene carbonate compound; and a seal for retaining the grease in the bearing.

2. A rock bit as recited in claim 1 comprising the 1,3,4-thiadiazole compound in the range of from 0.1 to 25 percent by weight and the sulfur-chloride-phosphorus compound in the range of from 1 to 10 percent by weight of the total grease composition.

3. A rock bit as recited in claim 1 comprising the molybdenum-sulfur-phosphorus compound in the range of from 1 to 10 percent by weight of the total grease composition.

4. A rock bit as recited in claim 1 comprising the alkyl ester copolymer in the range of from 0.1 to 5 percent by weight of the total grease composition.

5. A rock bit as recited in claim 1 comprising the silica gel compound in the range of from 2 to 8 percent by weight of the total grease composition.

6. A rock bit as recited in claim 1 wherein the grease composition has an absolute viscosity greater than about 100,000 centipoise at a temperature of 70° F. and at a shear rate less than 40 seconds$^{-1}$.

7. A rock bit as recited in claim 1 wherein the grease composition comprises approximately 2 percent by weight polyisobutylene, 76 percent by weight ethylene-alphaolefin and 6 percent by weight polyalphaolefin.

8. The rock bit as recited in claim 1 wherein the grease composition comprises approximately 3 percent by weight 1,3,4-thiadiazole, 5 percent by weight chloride-sulfur-phosphorus compound, 0.3 percent by weight alkyl ester copolymer, 3 percent by weight molybdenum-sulfurphosphorus compound, 5 percent by weight silica gel and 0.3 percent by weight propylene carbonate.

9. A method for lubricating a rock bit for drilling subterranean formations, the rock bit including a bit body and a plurality of cutter cones mounted on the bit body with rotatable journal bearings, comprising the steps of:

evacuating a portion of the rock bit body including the journal bearings;

introducing a solid metal free grease composition into the evacuated portion of the rock bit body and journal bearings, the grease composition comprising in the range of from about 55 to 95 percent by weight synthetic lubricant basestock, in the range of from about 4 to 45 percent by weight lubricant additives, and having a viscosity index in the range of from 250 to 325, wherein the synthetic lubricant basestock is formed by combing:

in the range of from about 1 to 20 percent by weight polyisobutylene having a Flory molecular weight in the range of from 42,000 to 46,000;

in the range of from about 50 to 90 percent by weight ethylene-alphaolefin having a Flory molecular weight in the range of from 32,000 to 38,000; and up to about 40 percent by weight polyalphaolefin having a molecular weight in the range of from 800 to 2,000; and wherein in the lubricant additives are prepared by combining:

1,3,4-thiadiazole compound;

a sulfur-chloride-phosphorus compound;

an alkyl ester copolymer;

a silica gel compound; and a propylene carbonate compound; and sealing the grease within the rock bit body.

10. The method as recited in claim 9 wherein the grease composition has an absolute viscosity greater than about 100,000 centipoise at approximately 70° F. at a shear rate less than about 40 seconds$^{-1}$.

11. A grease composition for lubricating rotary cone rock bits comprising:

in the range of from about 55 to 95 percent by weight synthetic lubricant basestock comprising:

in the range of from about 1 to 20 percent by weight polyisobutylene having a Flory molecular weight in the range of from 42,000 to 46,000;

in the range of from about 50 to 90 percent by weight ethylene,-alphaolefin having a Flory molecular weight in the range of from 32,000 to 38,000; and up to about 40 percent by weight polyalphaolefin having a molecular weight in the range of from 800 to 2,000; and in the range of from about 5 to 45 percent by weight lubricant additives comprising:

a 1,3,4-thiadiazole compound;

a sulfur-chloride-phosphorus compound;

an alkyl ester copolymer;

a silica gel compound; and a propylene carbonate compound;

wherein the grease composition is free of solid metals and has a viscosity index in the range of from about 250 to 325.

12. The grease composition as recited in claim 11 further having an absolute viscosity greater than about 100,000 centipoise at a temperature of approximately 70° F. and at a shear rate of less than about 40 seconds$^{-1}$.

* * * * *